US005655861A

United States Patent [19]

Bardeen et al.

[11] Patent Number: 5,655,861

[45] Date of Patent: Aug. 12, 1997

[54] HAND-HELD DRILLING TOOL

[75] Inventors: Kea L. Bardeen; John P. Bardeen, both of Denver; Timothy J. Martin, Lakewood; Bernard F. Deneke, Littleton, all of Colo.

[73] Assignee: Pumpkin Ltd., Denver, Colo.

[21] Appl. No.: 549,357

[22] Filed: Oct. 27, 1995

[51] Int. Cl.[6] ..... B26F 1/32

[52] U.S. Cl. ..... 408/227; 30/358; 408/224

[58] Field of Search ..... 408/223, 224, 408/225, 227, 228; 30/315, 316, 358, 361

[56] References Cited

U.S. PATENT DOCUMENTS

| | | | |
|---|---|---|---|
| 743,335 | 3/1903 | Rogers . | |
| 984,323 | 2/1911 | Vauclain . | |
| 2,011,910 | 8/1935 | Robbins . | |
| 2,276,771 | 3/1942 | Hawker | 408/227 |
| 2,883,888 | 4/1959 | Stewart . | |
| 3,263,721 | 8/1966 | Ewaskowitz . | |
| 3,737,245 | 6/1973 | Mater . | |
| 3,920,350 | 11/1975 | Southall . | |
| 3,945,753 | 3/1976 | Byers et al. . | |
| 3,965,574 | 6/1976 | Graves | 30/315 |
| 4,134,706 | 1/1979 | Stewart . | |
| 4,135,847 | 1/1979 | Hemmings . | |
| 4,296,659 | 10/1981 | Nauman | 30/315 |
| 4,682,917 | 7/1987 | Williams, III et al. . | |

FOREIGN PATENT DOCUMENTS

| | | | |
|---|---|---|---|
| 2271948 | 5/1994 | United Kingdom | 408/225 |

*Primary Examiner*—Steven C. Bishop

*Attorney, Agent, or Firm*—Timothy J. Martin; Michael R. Henson

[57] ABSTRACT

A hand-held drilling tool has at least one but preferably two blade structures which project longitudinally from a transverse base member to terminate in a distal end that forms a cutting element. Each blade structure has a pair of blade sections that are joined together along the longitudinal axis and that extend radially therefrom to terminate in lateral edges. Where two blade structures are present, each forms a handle for rotatably operating the other blade structure; where only one blade structure is present, a flattened handle is provided. The blade structures can have different blade widths for drilling differently sized holes. The blade sections may be offset from one another, and wedge-shaped feet may be disposed on the cutting elements. One of the blade structures can have both a bit portion and a shank portion of different widths. A pilot tip may also be provided on the distal ends of the blade structures. The drilling tool is configured for unitary molding from a plastic material.

38 Claims, 6 Drawing Sheets

HAND-HELD DRILLING TOOL

FIELD OF THE INVENTION

The present invention relates to a hand-held drilling tool which is adapted for use to bore a hole into a selected material. More particularly, the present invention is directed to a hand-held drilling tool for boring holes into fruits such as pumpkins and watermelons whereby, for example, a candle can then be inserted and securely mounted thereinto.

BACKGROUND OF THE INVENTION

Pumpkin carving has become a popular pastime especially during the Halloween season. In fact, pumpkin carving has become so popular that there is now a demand for a variety of pumpkin carving implements including pumpkin face patterns, carving tools and drilling tools as well as a variety of pumpkin carving kits. These pumpkin carving implements and kits can be used by children or adults with a carving skill level ranging from a hobbyist to a professional.

Often, during Halloween season, scary faces are carved into pumpkin shells and, during night hours, a lit candle is placed into the pumpkin shell so that the scary face is brightly illuminated in the dark of night for any passers-by who dare to view it. Either short, slender candles or votive candles are employed for this purpose. Usually, votive candles are set, unsecured, into the pumpkin. Homemade holders of aluminum foil and pins, or candles set onto plates with wax are sometimes used to hold candles. None of these methods hold the candles securely, allowing them to tip over and be extinguished or even permitting them to fall out of the pumpkin. Also none of these methods contains the wax of votive candles, therefore the burning time of votive candles is reduced. With the pumpkin carving industry aware of these problems associated with candles in pumpkins a wire device has been introduced. A first segment of the wire device is wrapped around the candle stock several times and the remaining segment at the bottom of the candle stock is coiled to form, in essence, a stand to be placed inside the pumpkin shell. While holding the candle securely in the pumpkin, the wire holder does nothing to contain the wax of the votive candle, allowing it to melt over the wire holder and spread across the bottom of the pumpkin. This significantly decreases the burning time of the votive candle.

Additionally, as candles burn in pumpkins it is necessary to provide a chimney or flue so that smoke and heat from the candle can escape. This flue or chimney is usually carved with a knife and consequently appears as an unsightly non-uniform, polygonal hole. This chimney is typically located at the top of the pumpkin proximately to the stem. Due to the thickness of the pumpkin shell near the stem, the difficulty of cutting such a chimney with a knife is increased as is the risk of injury to the carver.

There is a need in the industry to provide a hand-held drilling tool which can bore a cylindrical hole in a selected material such as a pulp or a skin of a pumpkin or some other fruit or vegetable. There is also a need in the industry to provide a single hand-held drilling tool which can bore cylindrical holes of varying diameters. Moreover a need exists for a lightweight, inexpensive drilling tool which may be used to form a hole in a carved pumpkin so that the pumpkin will securely hold a candle and will contain any melting wax to enhance candle life. Such tool should be capable of inclusion in a kit or sold alone. The present invention satisfies these needs and provides these benefits.

OBJECTS AND SUMMARY OF THE INVENTION

It is an object of the present invention to provide a hand-held drilling tool which can bore a cylindrical hole into a selected material such as a pulp or rind of a fruit or a vegetable.

Another object of the present invention is to provide a single hand-held drilling tool with multiple blade structures whereby while one blade structure is boring the hole i.e. working, the other blade structure is used as a handle for rotating and urging the working blade structure into the select material.

A further object of the present invention is to provide a drilling tool that can cut a bore in a pumpkin shell in such a manner so as to retain candle wax from a burning candle placed therein.

Still another object of the present invention is to provide a hand-held drilling tool having at least one blade structure capable of drilling a plurality of cylindrical holes having different diameters.

Yet still a further object of the present invention is to provide a hand-held drilling tool which is light-weight, easy and safe to use and inexpensive to manufacture.

Accordingly, a hand-held drilling tool of the present invention is adapted for boring a hole into a selected material such as a pulp or a rind of a fruit or vegetable. In its broadest form, the hand-held drilling tool of the present invention includes a base member, a first blade structure and a second blade structure. The base member has opposite first and second base surfaces. The first blade structure is connected to the base member and projects from the first base surface in a first direction along a longitudinal axis to terminate at a first distal end in a first cutting element. The second blade structure is connected to the base member and projects from the second base surface in a second direction opposite of the first direction to terminate at a second distal end in a second cutting element. During operation, as one of either the first and second blade structures contacts the selected material, a remaining one of the first and second blade structures acts as a handle for gripping by a user. While the user grips the blade structure acting as the handle, a torsional force can be applied to the handle to gain a mechanical advantage for rotating the hand-held drilling tool while simultaneously a normal force can be applied to the base member for advancing the hand-held drilling tool into the selected material thereby boring the hole thereinto.

Each of the first and second blade structures includes a pair of flat blade sections which are respectively connected to each other longitudinally along and about the longitudinal axis and extend opposite one another transversely from the longitudinal axis. Each of the blade sections has a working surface and a rear surface which are disposed opposite one another. Preferably, the first blade sections are connected to each other in an offset manner and the second blade sections are connected to each other in an offset manner whereby the rear surfaces of the first and second blade sections and the longitudinal axis are disposed in a common plane.

Each of the first and second cutting elements includes a pair of wedge-shaped feet with each foot having a leading cutting edge projecting outwardly from the working surface. Each of the leading cutting edges is defined as a vertex that is formed by a wedging surface extending from the working surface and a foot surface extending from the rear surface. The foot surface defines a foot plane that could be oriented either perpendicularly to the longitudinal axis or obliquely to the longitudinal axis. When the foot plane is oblique to the longitudinal axis, the foot surface extends inwardly relative to the base member from the leading cutting edge towards the rear surface.

Each of the first and second wing portions of at least one of the first and second blade structures has a longitudinally-extending lateral sidewall which extends between the respective ones of the working and rear surfaces. Each of the first and second wing portions includes a paring edge defined as a second vertex which is formed by respective ones of the working surfaces and the lateral sidewalls. Further, each of the lateral sidewalls is canted inwardly relative to the longitudinal axis from the working surface toward the rear surface.

Preferably, the first blade structures includes a bit section and a shank section. The shank section is disposed between the bit section and an associated one of the first and second base surfaces. The shank section has a shank width and the bit section has a bit width that is less than the shank width. The lateral side edges that extend along the bit section form longitudinally-extending bit sidewalls that extend and are canted inwardly from the working surface to the rear surface to define a longitudinally-extending bit paring edges on the bit section. It is preferred that the lateral side edges extend along the shank section and are canted inwardly from the working surface to the rear surface to define a longitudinally-extending shank paring edges on the shank section.

Additionally, the hand-held drilling tool includes an elongated pilot tip which is connected to each of the first and second blade structures at respective ones of the first and second distal ends thereof. The pilot tip extends centrally about and longitudinally along the longitudinal axis in a forward direction away from the base member. Each of the pilot tips can be formed in a shape of a cone, a combination cylinder and cone, a dome, a combination frustum and dome and/or a bullet.

Preferably, the base member, the first blade structure and the second blade structure are formed of a unitary construction and are fabricated from a plastic material. The base member has a peripheral edge configured in an oval shape that surrounds first and second blade structures.

An alternate exemplary embodiment of the hand-held drilling tool of the present invention includes the base member, a flattened handle and a blade structure. Another alternate exemplary embodiment of the hand-held drilling tool of the present invention includes the base member, the handle and the blade structure having the cutting element formed in cross-section in a shape of a wedge-shaped foot. Yet another alternate exemplary embodiment of the hand-held drilling tool of the present invention includes the cutting element having an arcuate configuration.

These and other objects of the present invention will become more readily appreciated and understood from consideration of the following detailed description of the exemplary embodiments of the present invention when taken in conjunction with the accompanying drawings, in which:

BRIEF DESCRIPTION OF THE DRAWINGS

FIG. 12 is a cross-sectional view of a bit section of the first blade structure of the second exemplary embodiment of the hand-held drilling tool of the present invention taken along line 12—12 of FIG. 11;

DETAILED DESCRIPTION OF THE EXEMPLARY EMBODIMENTS

Although not by way of limitation, four exemplary embodiments of a hand-held drilling tool of the present invention which is adapted for boring a hole into a selected material are hereinafter described. Throughout the description of the exemplary embodiments of the present invention, the terms, "first" and "second", are often used. One of ordinary skill in the art would appreciate that such terms are not limiting in nature to the description of the exemplary embodiments and would comprehend that the term "first" can be substituted in lieu of the term "second" and vice versa without departing from the spirit and inventive concepts described herein.

Figure 1:
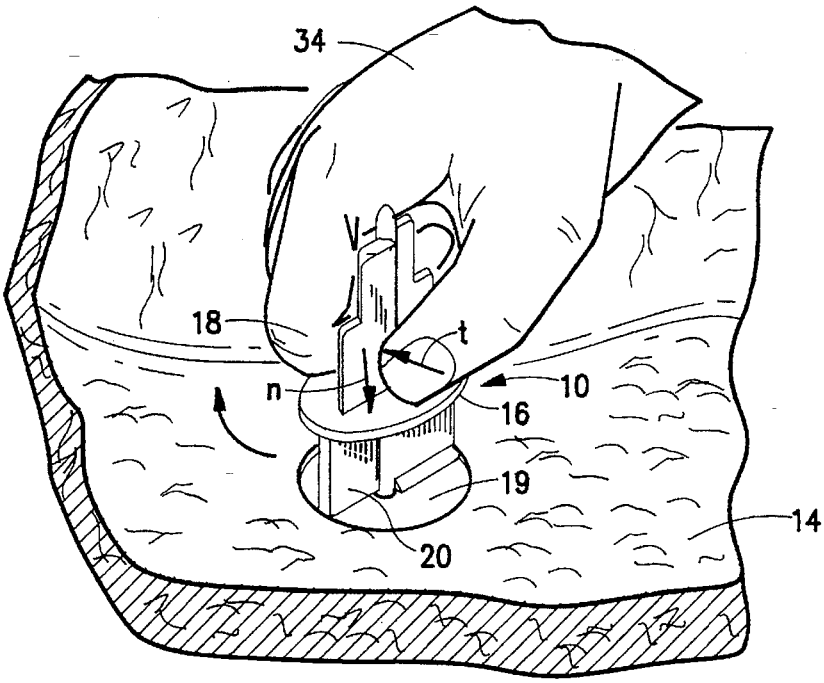
FIG. 1 is a perspective view of a first exemplary embodiment of a hand-held drilling tool of the present invention illustrating a user boring a hole into a pulp of a large fruit such as a pumpkin.

As generally introduced in FIGS. 1–11, a first exemplary embodiment of a hand-held drilling tool 10 of the present invention is illustrated. With reference to FIG. 1, hand-held drilling tool 10 is adapted for boring a hole 12 into a selected material 14. By way of example only and not of limitation, hand-held drilling tool 10 is particularly useful in the craft of pumpkin or watermelon carving. Therefore, holes or bores are formed into either the pulp or the rind of the fruit or vegetable, which will be discussed in further detail below. For the exemplary embodiments hereinafter described, the selected material 14 is a pumpkin shell.

Figure 2:
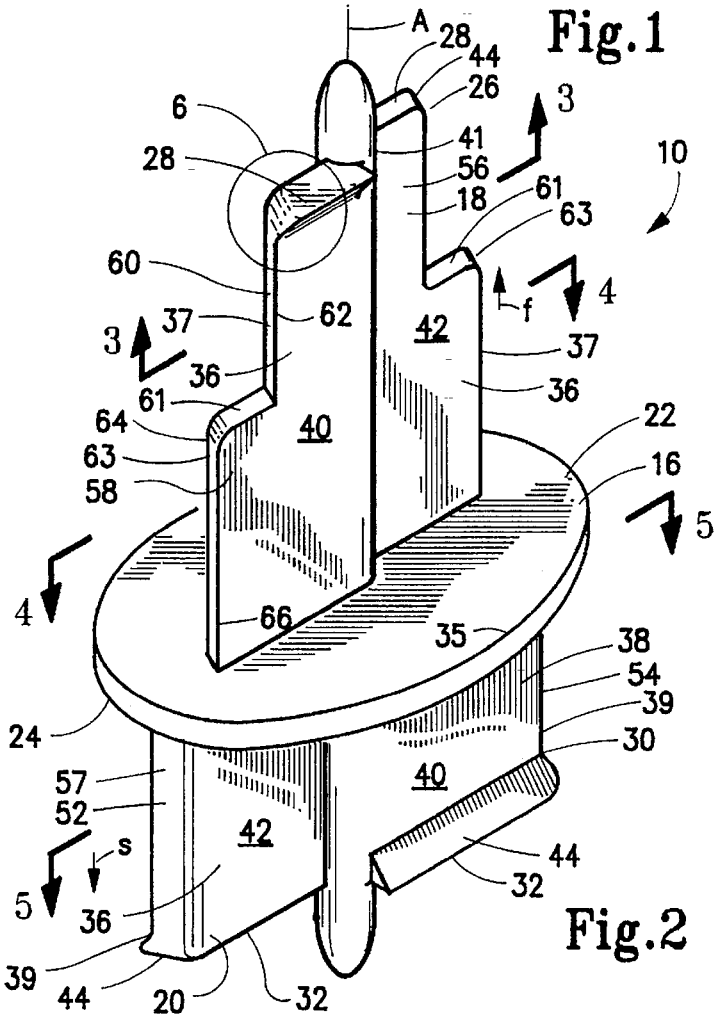
FIG. 2 is an enlarged perspective view of the first exemplary embodiment of the hand-held drilling tool of the present invention shown in FIG. 1.

As best shown in FIG. 2, hand-held drilling tool 10 includes a flat base member 16, a first blade structure 18 and a second blade structure 20. Base member 16 has opposite first and second base surfaces 22 and 24, respectively, and is oriented transversely to longitudinal axis "A". First blade structure 18 is connected to base member 16 and projects from first base surface 22 in the first direction "f" (indicated by arrow "f") along a longitudinal axis "A". First blade structure 18 terminates at a first distal end 26 in a first cutting element 28 and preferably has a longitudinal length of about 1.9 to 3.2 cm (¾" to 1¼"). Second blade structure 20 is connected to base member 16 and projects from second base surface 24 in a second direction "s" (indicated by arrow "s") which is opposite of first direction "f". Second blade structure 20 terminates at a second distal end 30 in a second cutting element 32.

Operation of hand-held drilling tool 10 is best illustrated in FIG. 1. As second blade structure 20 contacts selected material 14, first blade structure 18 acts as a handle for gripping by a hand 34 of a user. Now, a torsional force "t" (indicated by an arrow "t") can be applied to the handle to gain a mechanical advantage for rotating hand-held drilling tool 10 while simultaneously a normal force "n" (indicated by an arrow "n") can be applied to base member 16 for advancing hand-held drilling tool 10 into selected material 14 thereby boring hole 12 thereinto. As described, hand-held drilling tool 10 has two blade structures extending opposite one another, and, is, therefore, invertible. As a result, a skilled artisan would appreciate that as first blade structure 18 contacts selected material 14, second blade structure 20 then acts as the handle for gripping by hand 34 of the user. Thus, as one of either the first blade structure 18 or the second blade structure 20 contacts selected material 14, then a remaining one of the first blade structure 18 and the second blade structure 20 acts as the handle.

Figure 4:
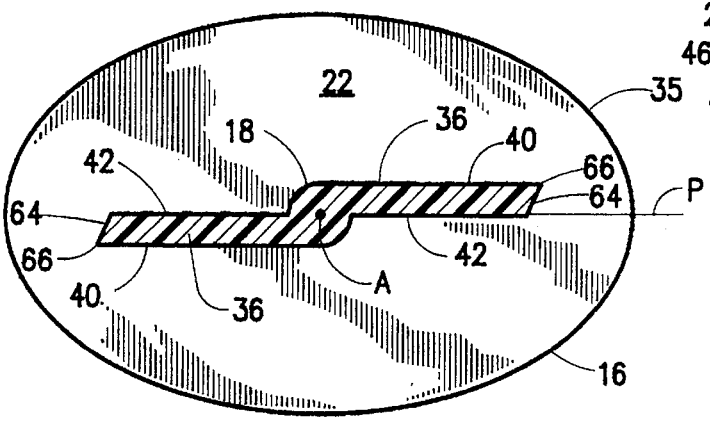
FIG. 4 is a cross-sectional view of a shank portion of the first blade structure of the first exemplary embodiment of the hand-held drilling tool of the present invention taken along line 4—4 of FIG. 2.
Figure 7:
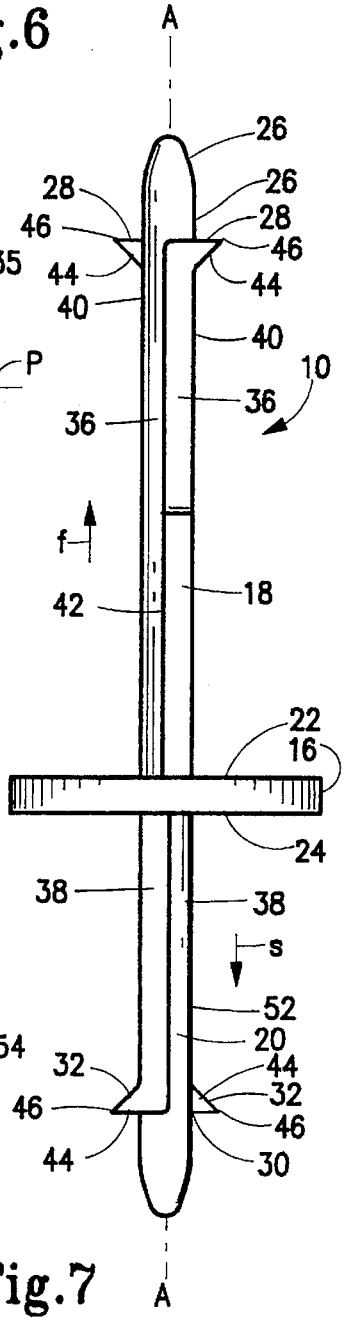
FIG. 7 is a side view in elevation of the first exemplary embodiment of the hand-held drilling tool of the present invention shown in FIG. 2.

With reference to FIGS. 2 and 4, base member 16 has a peripheral edge 35 which, for example purposes only, is configured in an oval shape. A skilled artisan would comprehend that peripheral edge 35 could be configured in other shapes such as squared or rounded. Although not by way of limitation, peripheral edge 35 of base member 16 surrounds first and second blade structures 18 and 20. Base member 16 may be located to limit the depth of a bore formed by either of first or second blade structures 18 and 20.

Figure 3:
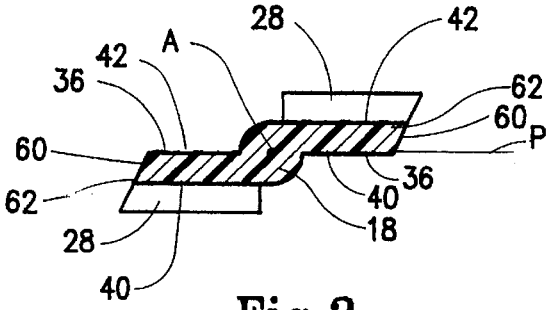
FIG. 3 is a cross-sectional view of a bit portion of a first blade structure of the first exemplary embodiment of the hand-held drilling tool of the present invention taken along line 3—3 of FIG. 2.
Figure 5:
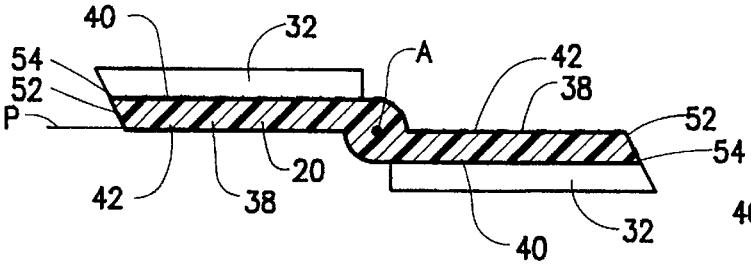
FIG. 5 is a cross-sectional view of a second blade structure of the first exemplary embodiment of the hand-held drilling tool of the present invention taken along line 5—5 of FIG. 2.

As best shown in FIGS. 2–5, each of first blade structure 18 includes a pair of first flat blade sections 36 which are joined together along longitudinal axis "A". Second blade structure 20 includes a pair of second flat blade sections 38 which are connected to each other along longitudinal axis "A". Each of blade sections 36 and 38 extend radially from longitudinal axis "A" to terminate respectively in lateral side edges 37, 39. Each of first and second blade sections 36 and 38 has a working surface 40 and a planar rear surface 42 disposed oppositely one another. As best shown in FIGS. 3–5, first blade sections 36 are connected to each other in an offset manner, and, likewise, second blade sections 38 are offset with respect to one another. Specifically, rear surfaces 42 of first and second blade sections 36, 38 and longitudinal axis "A" are disposed in a common plane "P".

Figure 6:
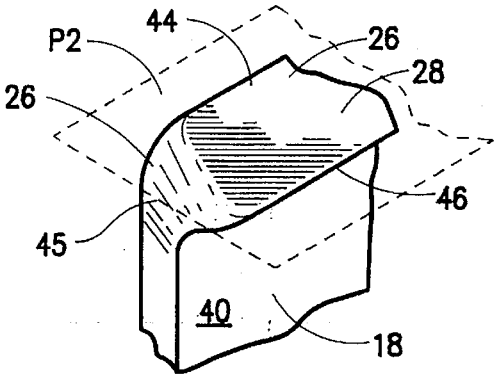
FIG. 6 is an enlarged fragmentary view of a portion of the cutting element on the first blade structure taken from circle 6 of FIG. 2 showing arcuate corners of the cutting element as well as the first blade structure formed with the cutting element.
Figure 8:
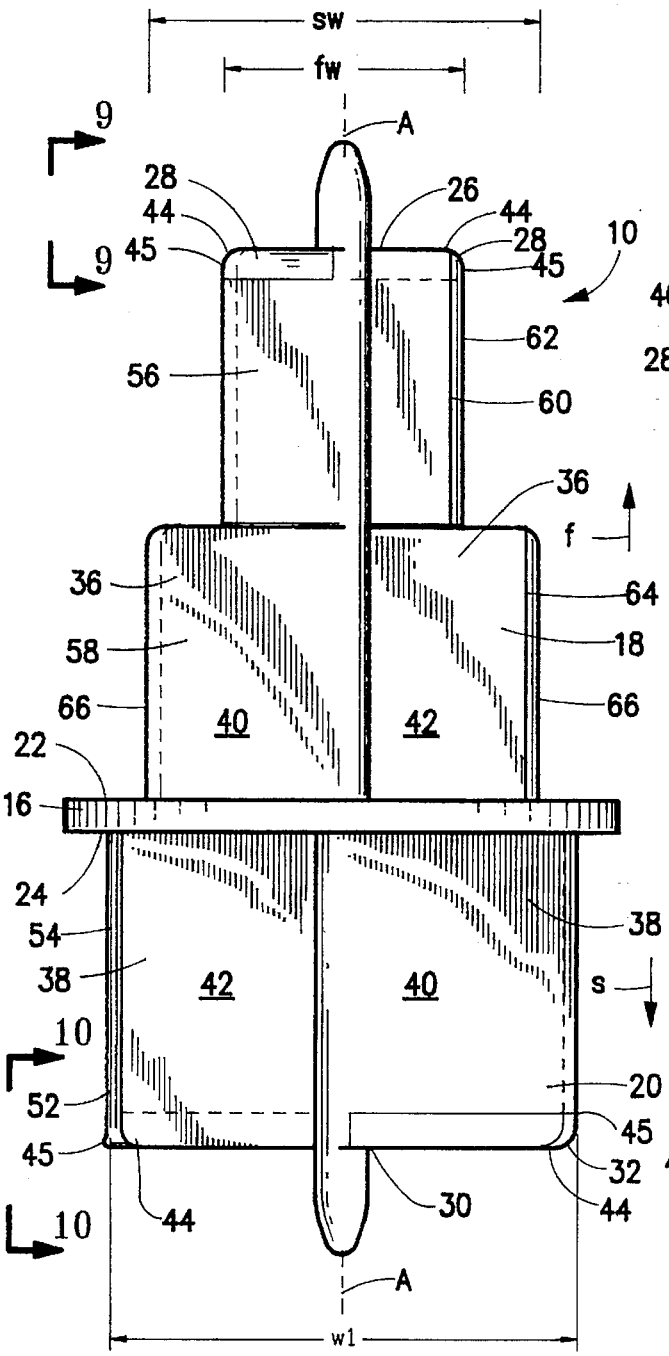
FIG. 8 is a front view in elevation of the first exemplary embodiment of the hand-held drilling tool of the present invention shown in FIG. 2.
Figure 9:
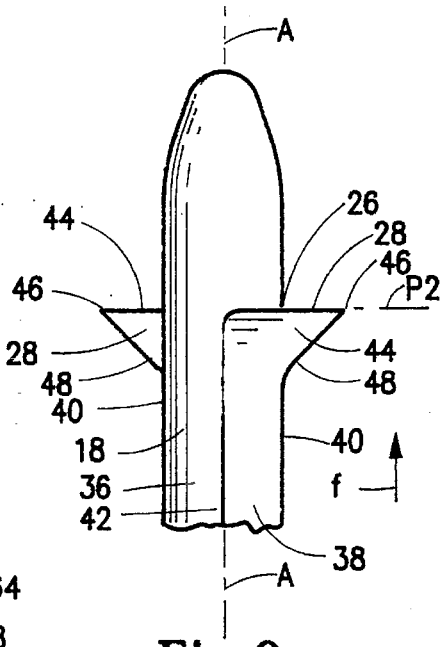
FIG. 9 is a fragmentary side view in elevation of a pilot tip and cutting elements connected to the first blade structure of the hand-held drilling tool of the present invention taken along line 9—9 in FIG. 8.
Figure 10:
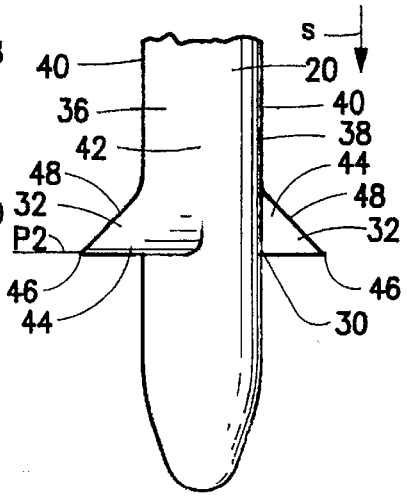
FIG. 10 is a fragmentary side view in elevation of a pilot tip and cutting elements connected to the second blade structure of the hand-held drilling tool of the present invention taken along line 10—10 in FIG. 8.
Figure 14:
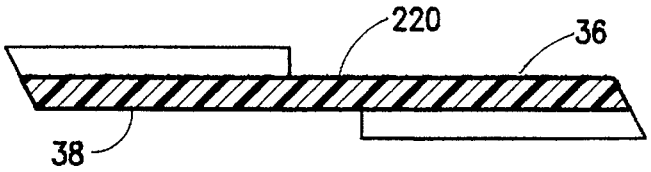
FIG. 14 is a cross-sectional view of the second blade structure of the second exemplary embodiment of the hand-held drilling tool of the present invention taken along line 14—14 of FIG. 11.

Although not by way of limitation, each of first and second cutting elements 28 and 32 includes a pair of wedge-shaped feet 44 as best shown in FIGS. 6–10. As shown in FIG. 6, each wedge-shaped foot 44 has contoured corners which are rounded to form arcuate surfaces 45. These rounded corners are thus located at the intersection of the lateral side edges of the blade structure with the distal end thereof. Moreover, thee corners provide a safety feature in that the user can avoid impaling or scratching himself/herself when employing the present invention. Further, each wedge-shaped foot 44 has a leading cutting edge 46 which projects outwardly from working surface 40. With reference to FIGS. 9 and 10, each of leading cutting edges 46 is defined as a vertex formed by a wedging surface 48 which interconnects the respective working surface 40 and the respective rear surface 42. In FIGS. 6, 9 and 10, foot surface 50 defines a foot plane "P2". For the first exemplary embodiment of hand-held drilling tool 10 of the present invention, foot plane "P2" is perpendicular to longitudinal axis "A".

As best shown in FIGS. 2, 5 and 8, each of second blade sections 38 of second blade structure 20 has a longitudinally-extending lateral sidewall 52 for the first exemplary embodiment of hand-held drilling tool 10 of the present invention. Each lateral sidewall 52 extends between respective ones of working surfaces 40 and rear surfaces 42. Also, each of first and second blade sections 36 and 38 includes a paring edge 54 which is defined as a second vertex formed by respective ones of working surfaces 40 and lateral sidewalls 52. Further, each of lateral sidewalls 52 is canted inwardly relative to longitudinal axis "A" from working surface 40 toward rear surface 42. Second blade structure 20 has a width "w". Preferably, width "w" is approximately 2.86 cm (1⅛ inches) to accommodate the size of a votive candle. Second blade structure 20 has a longitudinal length of about 2.22 to 2.54 cm (⅞ inch to 1 inch) as measured from base member 16 to second distal end 30. Thus, base member 16 acts to prevent drilling a bore for the votive candle that is too deep into the pumpkin shell.

As best illustrated in FIGS. 2, 3, 4 and 8, first blade structure 18 includes a bit portion 56 and a shank portion 58. Shank portion 58 is disposed between bit portion 56 and first base surface 22. Shank portion 58 has a shank width "ws" and bit portion 56 has a bit width "bs" that is less than shank width "sw". Preferably, although not by way of limitation, bit width "bw" is approximately 0.95 cm (⅜ inch) and shank width "sw" is approximately 2.54 cm (1 inch). Bit portion 56 has a longitudinally-extending bit sidewall 60 which extends and is canted inwardly from working surface 40 to rear surface 42 to define a longitudinally-extending bit paring edge 62 on each first blade sections 36. Shank portion 58 has a longitudinally-extending shank sidewall 64 which extends and is canted inwardly from working surface 40 to rear surface 42 to define a longitudinally-extending shank paring edge 66 on each first and second wing portions 36 and 38 of first blade structure 18. Shank sidewalls 64 and bit sidewalls 60 thus form the lateral edges for first blade structure 18. A shoulder wall 61 thus interconnects bit sidewall 60 and shank sidewall 64. The intersection of these should walls 61 and shank sidewalls 64 is contoured to have a radius thereby forming arcuate surfaces 63, again for safety.

As best shown in FIGS. 9 and 10, hand-held drilling tool 10 includes an elongated pilot tip 68 which is connected to each of first and second blade structures 18 and 20 at respective ones of first and second distal ends 26 and 30 thereof. Each pilot tip 68 extends centrally about and longitudinally along longitudinal axis "A" in a forward direction away from base member 16. For the first exemplary embodiment of hand-held drilling tool 10 of the present invention, pilot tip 68 is bullet shaped and has a longitudinal length of at least 0.60 cm (about ¼ inch). This length has been found to be important where the drilling tool is used on pumpkins. A lesser length can allow the blade structure to drift from position against the fleshy pulp of the pumpkin.

It is preferred that hand-held drilling tool 10 of the present invention has base member 16, first blade structure 18 and second blade structure 20 formed of a unitary construction. Typically, although not by way of limitation, base member 16, first blade structure 18 and second blade structure 20 are fabricated from a conventional plastic material. By fabricating the hand-held drilling tool of the present invention in plastic, the hand-hand drilling tool would be light-weight and sturdy as well as easy and inexpensive to manufacture.

A second exemplary embodiment of a hand-held drilling tool 210 is introduced in FIGS. 11–17. Hand-held drilling tool 210 is substantially similar to the first exemplary embodiment of hand-held drilling tool 10 of the present invention. However, the pair of first sections 36 and the pair of second wing sections 38 are connected to each other in a manner to form planar first and second blade structures 218 and 220. In other words and by way of example, working surface 40 of first wing portion 36 of first blade structure 218 and rear surface 42 of second wing portion 38 of first blade structure 218 coexist in a same plane "P3". Likewise, as would be understood by one of ordinary skill in the art, the other remaining corresponding working surfaces and rear surfaces would coexist in their own respective planes to create this flattened feature of first and second blade structures 218 and 220.

Figure 11:
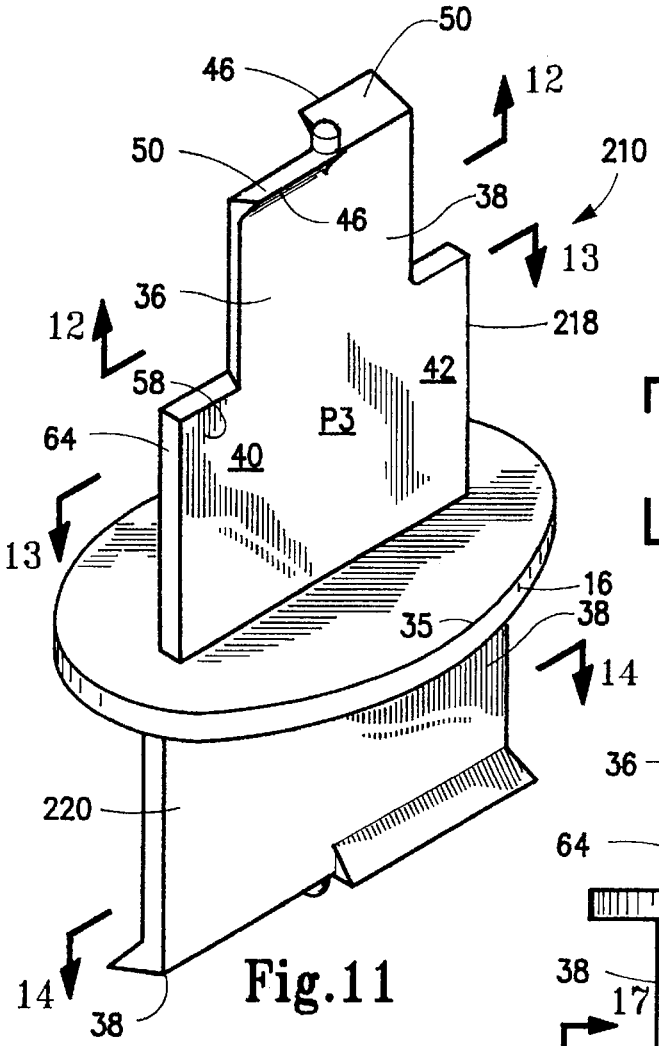
FIG. 11 is a perspective view of a second exemplary embodiment of the hand-held drilling tool of the present invention.
Figure 15:
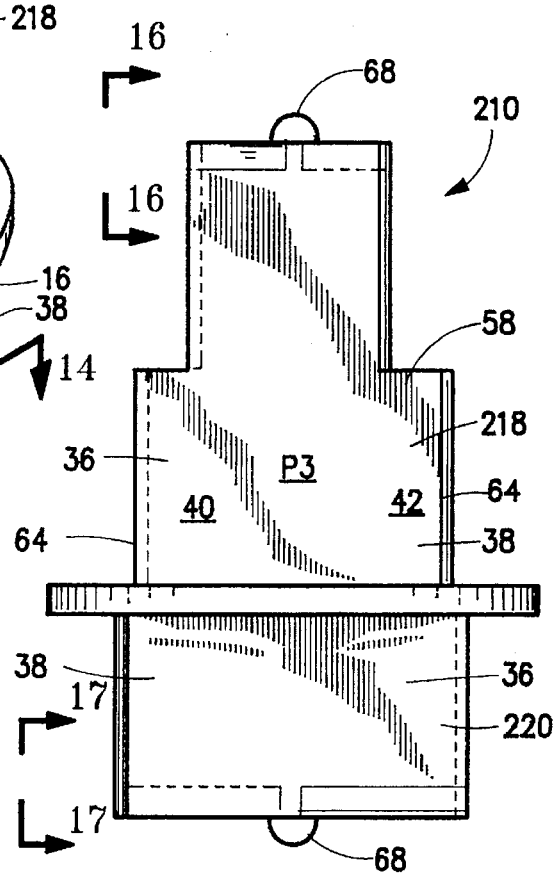
FIG. 15 is a front view in elevation of the second exemplary embodiment of the hand-held drilling tool of the present invention shown in FIG. 11.
Figure 13:
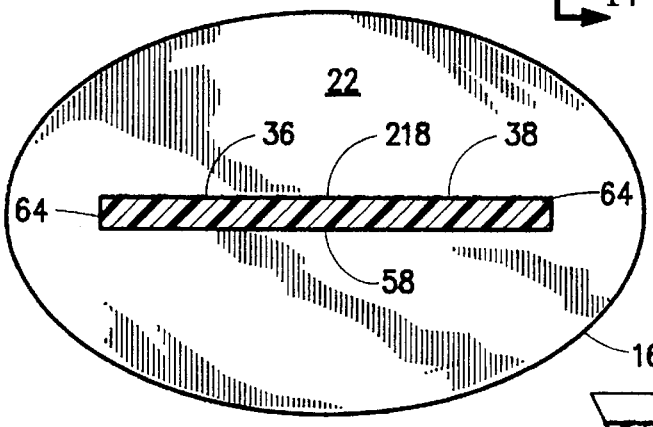
FIG. 13 is a cross-sectional view of a shank portion of the first blade structure of the second exemplary embodiment of the hand-held drilling tool of the present invention taken along line 13—13 of FIG. 11.

Another distinguishing feature of the second exemplary embodiment of drilling tool 210 of the present invention is how shank sidewalls 64 of shank portion 58 are oriented relative to respective ones of working surfaces 40 and rear surfaces 42. As best shown in FIGS. 11, 13 and 15, each shank sidewall 64 is oriented perpendicularly with respect to each working surface 40 and rear surface 42. Thus, the paring edges on shank portion 58 is a right-angled edge.

Figure 16:
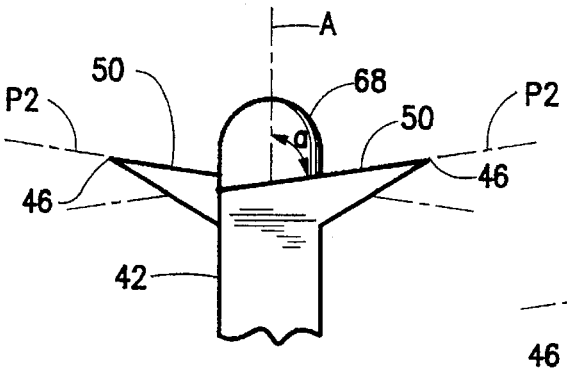
FIG. 16 is a fragmentary side view in elevation of a pilot tip and cutting elements connected to the first blade structure of the hand-held drilling tool of the present invention taken along line 16—16 in FIG. 15.
Figure 17:
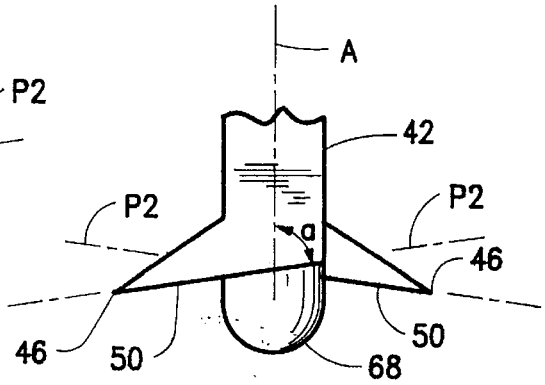
FIG. 17 is a fragmentary side view in elevation of a pilot tip and cutting elements connected to the second blade structure of the hand-held drilling tool of the present invention taken along line 17—17 in FIG. 15.

Two other distinguishing features of the second exemplary embodiment of drilling tool 210 are depicted in FIGS. 16 and 17. First, respective ones of foot planes "P2" are oblique to longitudinal axis "A" at an angle "a". Thus, each foot surface 50 extends inwardly relative to base member 16 from leading cutting edge 46 toward rear surface 42. Second, pilot tips 68 are configured in a shape of a dome.

Figure 18:
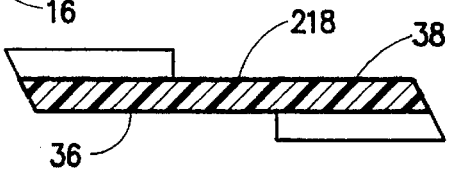
FIG. 18 is a perspective view of a third exemplary embodiment of the hand-held drilling tool of the present invention having a handle and a single blade structure with a bit portion and a shank portion.

A third exemplary embodiment of a hand-held drilling tool 310 of the present invention is shown in FIG. 18. One distinguishing feature here is that hand-held drilling tool 310 includes a flattened handle 370 extending in the first direction "f" and a first blade structure 318 extending in the second direction "s". Second blade structure includes bit portion 56 and shank portion 58. Leading cutting edge 46 is directed in a forward direction away from base member 16 and forms a vertex with a first flattened surface 372 and foot surface 50.

Figure 19:
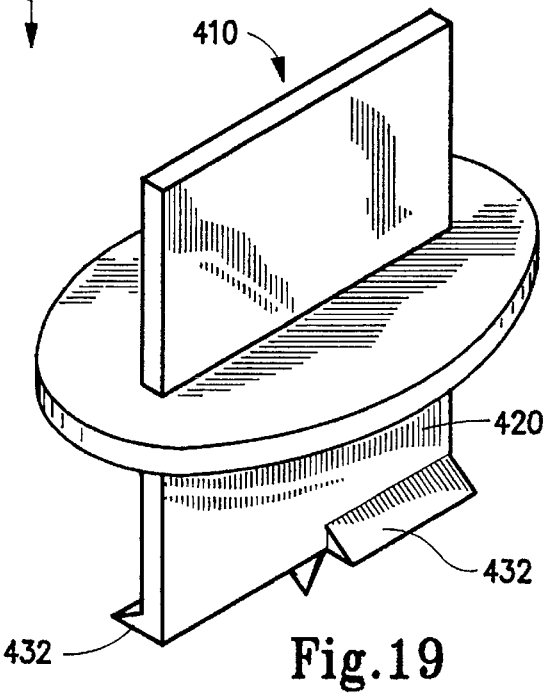
FIG. 19 is a perspective view of a fourth exemplary embodiment of the hand-held drilling tool of the present invention having a handle and a single blade structure.
Figure 20:
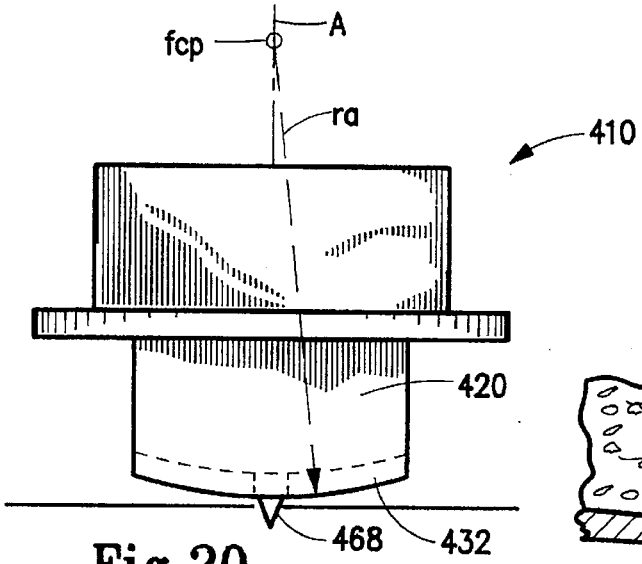
FIG. 20 is a side view in elevation of the fourth exemplary embodiment of the hand-held drilling tool of the present invention of FIG. 19 illustrating a cutting element with an arcuate configuration.
Figure 21:
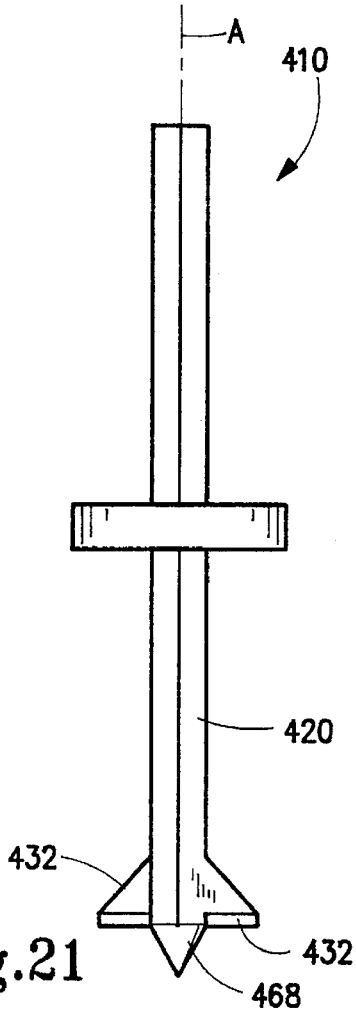
FIG. 21 is a side view in elevation of the fourth exemplary embodiment of the hand-held drilling tool of the present invention of FIG. 19.

A fourth exemplary embodiment of a hand-held drilling tool 410 is depicted in FIGS. 19–21. Blade structure 420 incorporates cutting elements 432 wherein each of cutting elements 432 is arcuate in configuration as best shown in FIGS. 20 and 21. Preferably, although not by way of limitation, the arcuate configuration of cutting elements 432 is formed by a radius, "ra", of about 15 cm (6 inches) in length. It is preferred that the fixed center point, "fcp", of radius "ra" is located on longitudinal axis "A" as shown in FIG. 20. Additionally, a pilot tip 468 is conical in shape.

Figure 22:
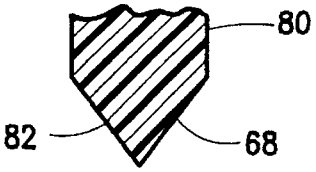
FIG. 22 is a side view in cross-section of an alternate configuration for a pilot tip.
Figure 23:
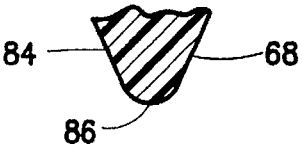
FIG. 23 is a side view in cross-section of another alternative configuration for a pilot tip.
Figure 18:
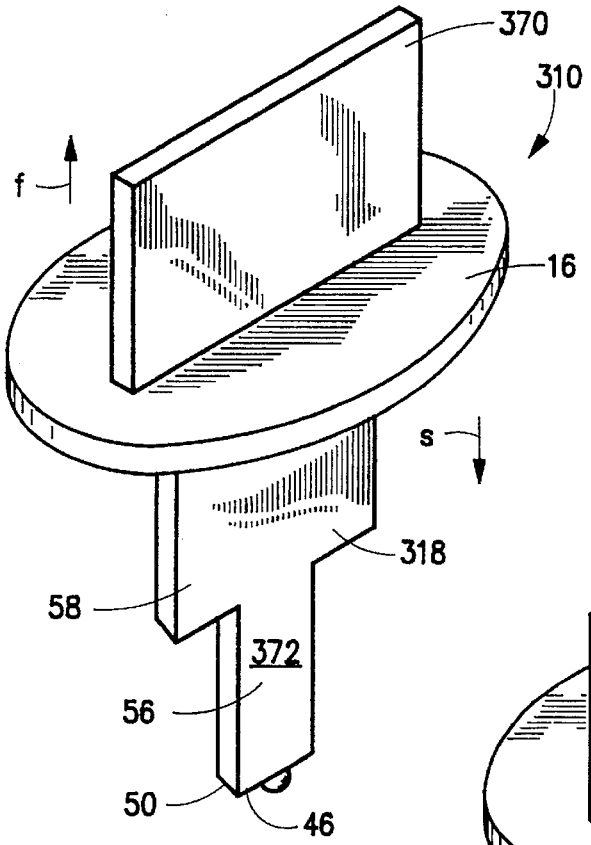

One of ordinary skill in the art would appreciate that the various individual features individually described in the four exemplary embodiments of the hand-held drill tool of the present invention can be rearranged in other permutations to form additional exemplary embodiments of the present invention. Furthermore, a skill artisan would appreciate that the pilot tips can also be configured in other shapes. For example, in FIG. 22, pilot tip 68 includes a cylindrical portion 80 integrally formed with a cone portion 82 to form a combination cylinder and cone and, in FIG. 23, pilot tip 68 includes a frustum portion 84 integrally formed with a dome portion 86 to form a combination frustum and dome.

Figure 25:
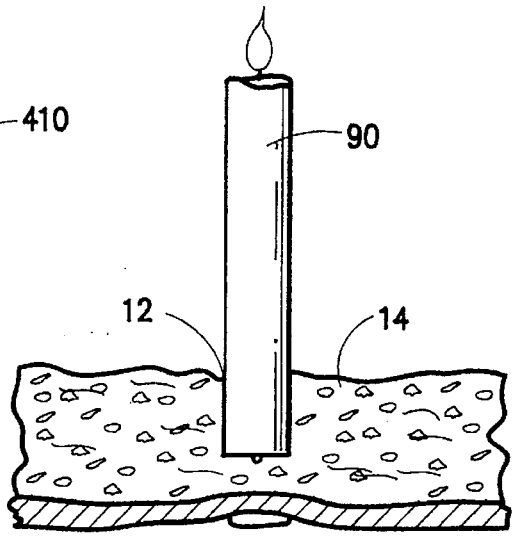
FIG. 25 is a side view in elevation of a table candle securely disposed in a bore formed in pulp of a pumpkin shown in cross-section.
Figure 24:
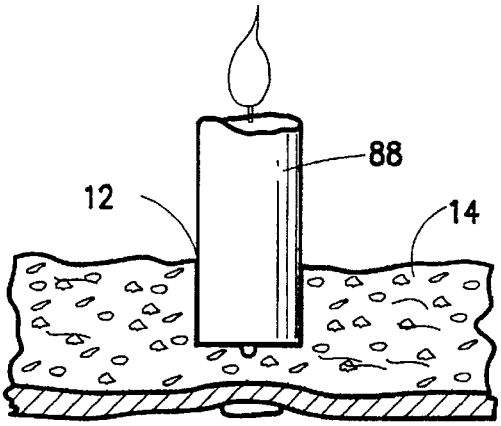
FIG. 24 is a side view in elevation of a votive candle securely disposed in a hole formed in pulp of a pumpkin shown in cross-section.
Figure 26:
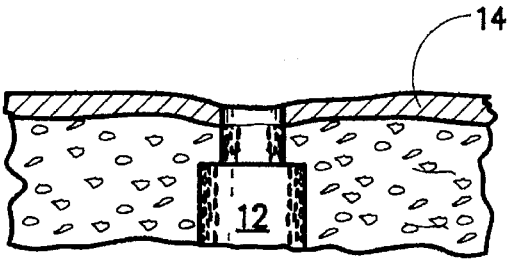
FIG. 26 is a side view in cross-section of a pumpkin pulp and rind with a step-down bore of two different diameters formed by the bit section and the shank section of the first blade structure of the hand-held drilling tool of the present invention.

The hand-held drilling tool of the present invention is particularly useful in boring holes in the pulp or the skin of a pumpkin. As shown in FIG. 24, the hand-held drilling tool of the present invention has formed hole 12 in pumpkin pulp 14. Hole 12 which is typically formed by the bit section of the first blade structure is sized and adapted to receive a votive candle 88. As shown in FIG. 25, hole 12 in pumpkin pulp 14 which is typically formed by the second blade structure is sized and adapted to receive a table candle 90. It is preferred that either of these holes 12 are sized to be approximately 0.15 to 0.3 cm (1/16 to ⅛ inch) in diameter less than the diameter of the respective candle. The candle then must be forcefully implanted into the hole which, in turn, is securely supported therein by the pulp. In FIG. 26, hole 12 is formed by the bit section and shank section of the first blade structure to form a flue in a top portion of the pumpkin.

The hand-held drilling tool of the present invention can bore a cylindrical hole or holes of various diameters into a selected material such as a pulp or rind of a fruit or a vegetable. The single hand-held drilling tool of the present invention has multiple blade structures that are arranged in a manner whereby while one blade structure is boring the hole i.e. working, the other blade structure is used as a handle for rotating and urging the working blade structure into the select material. Although not by way of limitation, the hand-held drilling tool of the present invention has at least one blade structure with a bit section and a shank section which is now capable of drilling two cylindrical holes of different diameters or one step-down hole of two different diameters. Therefore, the method of the present invention comprises forming such holes in vegetable shells, especially to form a retention reservoir for the candle wax thereby prolonging the effective life of the candle, especially a votive candle.

Moreover, this tool can be used to form a chimney opening to allow for the escape of heat and soot from the burning of a candle. Here, after selecting the location of the chimney opening, the user drills a hole with bit portion 56 and continues so that shank portion 38 enlarges the opening. The lengths of the first blade structure is selected so that, when shank portion 58 extends completely in the shell, distal end of bit portion 56 will protrude through the opposite side. The user now uses the tool on the opposite side so that shank portion 58 enlarges the opening made by bit portion 56. The shank length is therefore selected to be slightly more than one half the thickness of a typical pumpkin shell at the stem region so that the chimney opening is formed with a diameter equal to the shank width.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

We claim:

1. A hand-held drilling tool adapted for use by a user to manually drill bores into a selected material, comprising:

(a) a base member oriented transversely to a longitudinal axis;

(b) a first blade structure connected to said base member and projecting longitudinally therefrom in a first direction to terminate at a first distal end in a first cutting element, said first blade structure including a pair of first flat blade sections which are joined together along the longitudinal axis and which extend radially away from the longitudinal axis to terminate in first lateral side edges; and (c) a second blade structure connected to said base member and projecting longitudinally therefrom in a second direction opposite the first direction to terminate at a second distal end in a second cutting element, said second blade structure including a pair of second flat blade sections which are joined together along the longitudinal axis and which extend radially away from the longitudinal axis to terminate in second lateral side edges, said first and second blade structures each sized and configured such that, when a first one of said first and second blade structures is positioned against the selected material, a second one of said first and second blade structures provides a handle to be grasped by the user for manual rotation thereby to rotatably drive said first one of said first and second blade structure thereby to form a bore in said selected material.

2. A hand-held drilling tool according to claim 1 wherein said first blade sections project in opposite radial directions and wherein said second blade sections project in opposite radial directions and wherein each of said first and second blade sections has a planar working surface and a planar rear surface opposite the working surface thereof.

3. A hand-held drilling tool according to claim 2 wherein said first blade sections are offset from one another and said second blade sections being offset from one another.

4. A hand-held drilling tool according to claim 3 wherein the rear surfaces of each of said first and second blade sections and said longitudinal axis are disposed in a common plane.

5. A hand-held drilling tool according to claim 2 wherein each of said first and second cutting elements includes a pair of wedge-shaped feet with each having a leading cutting edge projecting outwardly from said working surface, each of said leading cutting edges defined as a vertex formed by a wedging surface extending from said working surface and a foot surface, said foot surface interconnecting said wedging surface and said rear surface and defining a foot plane.

6. A hand-held drilling tool according to claim 5 wherein said foot plane is perpendicular to said longitudinal axis.

7. A hand-held drilling tool according to claim 5 wherein said foot plane is oblique to said longitudinal axis.

8. A hand-held drilling tool according to claim 7 wherein said foot surface extends inwardly relative to said base member from said leading cutting edge toward said rear surface.

9. A hand-held drilling tool according to claim 2 wherein each of said lateral side edges is defined by a lateral sidewall interconnecting a respective working surface and rear surface, each of said first and second blade sections including a paring edge disposed at intersections of respective ones of said working surfaces and said lateral sidewalls.

10. A hand-held drilling tool according to claim 9 wherein each of said lateral sidewalls is canted inwardly relative to said longitudinal axis from said working surface toward said rear surface.

11. A hand-held drilling tool according to claim 9 wherein the intersection of each paring edge and a respective distal end is arcuately contoured to form an arcuate surface.

12. A hand-held drilling tool according to claim 2 wherein said first blade structure includes a bit portion and a shank portion disposed between said bit portion and said base member, said shank portion having a shank width and said bit portion having a bit width that is less than said shank width.

13. A hand-held drilling tool according to claim 12 wherein said bit portion has a longitudinally-extending bit sidewall extending and being canted inwardly from said working surface to said rear surface to define a longitudinally-extending bit paring edge on each first and second wing portion and wherein said shank portion has a longitudinally-extending shank sidewall extending and being canted inwardly from said working surface to said rear surface to define a longitudinally-extending shank paring edge on each shank portion of each first blade section.

14. A hand-held drilling tool according to claim 13 including a shoulder surface extending between each bit sidewall and a respective shank sidewall.

15. A hand-held drilling tool according to claim 14 wherein an intersection of each shoulder surface and its respective shank sidewall is arcuately contoured to form an arcuate surface.

16. A hand-held drilling tool according to claim 11 wherein said second blade portion has a second blade width that is larger than said shank width.

17. A hand-held drilling tool according to claim 11 wherein said shank portion has a length that is 3.2 cm (1¼ inch), said bit portion has a length that is 2.22 to 2.54 cm (⅞ to 1 inch) and said second blade structure has a length that is 2.22 to 2.54 cm (⅞ to inch).

18. A hand-held drilling tool according to claim 1 including a first pilot tip disposed on said first distal end and extending along the longitudinal axis in the first direction and a second pilot tip disposed on said second distal end and extending along the longitudinal axis in the second direction.

19. A hand-held drilling tool according to claim 18 wherein each of said first and second pilot tips is formed in a shape selected from a group consisting of a cone, a combination cylinder and cone, a dome, a combination frustum and dome and a bullet.

20. A hand-held drilling tool according to claim 18 wherein each of said first and second pilot tips is at least 0.60 cm (about ¼ inch) in length.

21. A hand-held drilling tool according to claim 1 wherein each of said cutting elements is arcuate in configuration.

22. A hand-held drilling tool according to claim 1 wherein said base member, said first blade structure and said second blade structure are formed of a unitary, one-piece, plastic construction.

23. A hand-held drilling tool according to claim 1 wherein said base member has a peripheral edge configured in an oval shape.

24. A hand-held drilling tool according to claim 1 wherein said base member is sized such that the user may apply a force respectively in said first and second directions thereby to respectively advance said first and second blade structures into the selected material upon rotation thereof.

25. A hand-held drilling tool adapted for use by a user to manually drill bores into a selected material, comprising:

(a) a base member oriented transversely to a longitudinal axis;

(b) a flattened handle connected to said base member and projecting longitudinally therefrom in a first direction and terminating at a first distal end;

(c) a blade structure connected to said base member and projecting longitudinally therefrom in a second direction opposite the first direction to terminate at a second distal end, said blade structure including a pair of flat blade sections which are joined together along the longitudinal axis and which extend radially away from the longitudinal axis to terminate in lateral side edges, said handle sized and configured such that, when said blade structure is positioned against the selected material, said handle can be grasped by the user for manual rotation thereby to rotatably drive said blade structure thereby to form a bore in the selected material.

26. A hand-held drilling tool according to claim 25 wherein said blade sections project in opposite radial directions and wherein each of said blade sections has a planar working surface and a planar rear surface opposite the working surface thereof.

27. A hand-held drilling tool according to claim 26 wherein said blade sections are offset from one another.

28. A hand-held drilling tool according to claim 25 wherein an intersection of each lateral side edge and a respective distal end is arcuately contoured to form an arcuate surface.

29. A hand-held drilling tool according to claim 28 wherein said first blade structure includes a bit portion and a shank portion disposed between said bit portion and said base member, said shank portion having a shank width between shank lateral side edges and said bit portion having a bit width between bit lateral side edges that is less than said shank width.

30. A hand-held drilling tool according to claim 29 including a shoulder surface extending between each said bit lateral side edge and a respective shank lateral side edge, an intersection of each shoulder surface and its respective shank lateral side edge being arcuately contoured to form an arcuate surface.

31. A hand-held drilling tool according to claim 25 including a pilot tip disposed on said second distal end and extending along the longitudinal axis in the second direction.

32. A hand-held drilling tool adapted for use by a user to drill bores in fleshy fruits which bores are sized and adapted to support candles therein and to drill a hole through a shell region thereof to provide a chimney opening, comprising:

(a) a base member oriented transversely to a longitudinal axis;

(b) a first blade structure connected to said base member and projecting therefrom in a first direction to terminate at a first distal end in a first cutting element;

(c) a second blade structure connected to said base member and projecting longitudinally therefrom in a second direction opposite the first direction to terminate at a second distal end in a second cutting element, said first and second blade structures each sized and configured such that, when a first one of said first and second blade structures is positioned against the selected material, a second one of said first and second blade structures provides a handle to be grasped by the user for manual rotation thereby to rotatably drive said first one of said first and second blade structure thereby to form a bore in said selected material;

(d) a first elongated pilot tip disposed on said first distal end and extending along the longitudinal axis in the first direction; and (e) a second elongated pilot tip disposed on said second distal end and extending along the longitudinal axis in the second direction.

33. A hand-held drilling tool according to claim 32 wherein each of said first and second pilot tips is formed in a shape selected from a group consisting of a cone, a combination cylinder and cone, a dome, a combination frustum and dome and a bullet.

34. A hand-held drilling tool according to claim 32 wherein each of said first and second pilot tips is at least 0.60 cm (about ¼ inch) in length.

35. A hand-held drilling tool according to claim 32 wherein said first blade structure includes a pair of first flat blade sections which are joined together along the longitudinal axis and which extend radially away from the longitudinal axis to terminate in first lateral side edges and wherein said second blade structure includes a pair of second flat blade sections which are joined together along the longitudinal axis and which extend radially away from the longitudinal axis to terminate in second lateral side edges, and wherein said first and second blade structures are sized and configured such that each one can be gripped by the user and rotated thereby to rotatably advance the other thereby to manually drill bores in the selected material.

36. A hand-held drilling tool according to claim 35 wherein said first blade structure has a first blade width and said second blade structure has a second blade width that is larger than said first blade width.

37. A hand-held drilling tool according to claim 36 wherein said first blade width is about 0.95 cm (⅜ inch) and said second blade width is about 2.86 cm (1⅛ inch).

38. A hand-held drilling tool according to claim 32 wherein said first and second blade structure each have a longitudinal length of at least 2.22 cm (⅞ inch).

* * * * *